US012298090B2

(12) United States Patent
Lee et al.

(10) Patent No.: US 12,298,090 B2
(45) Date of Patent: May 13, 2025

(54) RADIATION COOLING DEVICE USING CERAMIC NANOPARTICLE MIXTURE

(71) Applicant: ZERC, Seoul (KR)

(72) Inventors: Heon Lee, Seoul (KR); Soo Min Son, Seoul (KR); Dong Woo Chae, Seoul (KR); Han Gyu Lim, Seoul (KR)

(73) Assignee: ZERC, Seoul (KR)

( * ) Notice: Subject to any disclaimer, the term of this patent is extended or adjusted under 35 U.S.C. 154(b) by 244 days.

(21) Appl. No.: 17/918,198

(22) PCT Filed: Apr. 8, 2021

(86) PCT No.: PCT/KR2021/004422
§ 371 (c)(1),
(2) Date: Feb. 14, 2023

(87) PCT Pub. No.: WO2021/206474
PCT Pub. Date: Oct. 14, 2021

(65) Prior Publication Data

US 2023/0304751 A1 Sep. 28, 2023

(30) Foreign Application Priority Data

Apr. 10, 2020 (KR) ..... 10-2020-0044215

(51) Int. Cl.
*F28F 13/18* (2006.01)

(52) U.S. Cl.
CPC ..... *F28F 13/185* (2013.01); *F28F 2245/06* (2013.01); *F28F 2255/20* (2013.01)

(58) Field of Classification Search
CPC ... F28F 13/185; F28F 2245/06; F28F 2255/20
USPC ..... 165/133
See application file for complete search history.

(56) References Cited

U.S. PATENT DOCUMENTS

| | | | |
|---|---|---|---|
| 10,941,990 B2 | 3/2021 | Raman et al. | |
| 2017/0248381 A1 | 8/2017 | Yang et al. | |
| 2018/0244928 A1* | 8/2018 | Van Overmeere ..... | C09D 5/004 |

FOREIGN PATENT DOCUMENTS

| | | | |
|---|---|---|---|
| CN | 101792869 A | * | 8/2010 |
| JP | 01067543 A | * | 3/1989 |
| JP | 2018-526599 A | | 9/2018 |
| KR | 10-2019-0101870 A | | 9/2019 |
| KR | 10-2036071 B1 | | 10/2019 |
| KR | 10-2019-0130985 A | | 11/2019 |

(Continued)

OTHER PUBLICATIONS

Keçebaş, Muhammed Ali. "Passive Radiative Cooling Using Optical Thin Film Coatings" Diss. Sabanci University, Jul. 2016, (113 pages in English).

*Primary Examiner* — Davis D Hwu
(74) *Attorney, Agent, or Firm* — NSIP Law

(57) ABSTRACT

The present invention relates to a technical idea of cooling the surface of a material or the internal temperature under the material by emitting heat under an element to the outside while minimizing absorption of light in the solar spectrum, and more particularly to a technology for developing a material having a high transmittance or high reflectance with respect to incident sunlight and a high absorptivity selectively in a wavelength range of 8 μm to 13 μm corresponding to the sky window section of the atmosphere.

11 Claims, 21 Drawing Sheets

(56) References Cited

FOREIGN PATENT DOCUMENTS

| | | | |
|---|---|---|---|
| KR | 10-2230348 | B1 | 3/2021 |
| WO | WO 2019/204331 | A1 | 10/2019 |

* cited by examiner

【FIG. 1A】
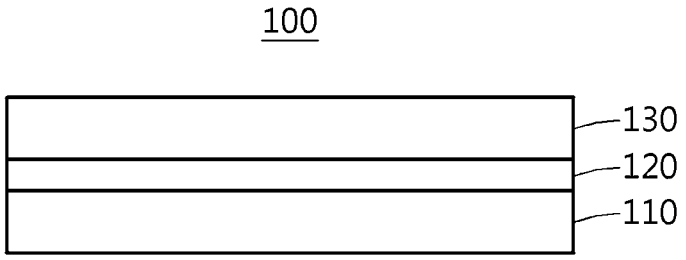

【FIG. 1B】
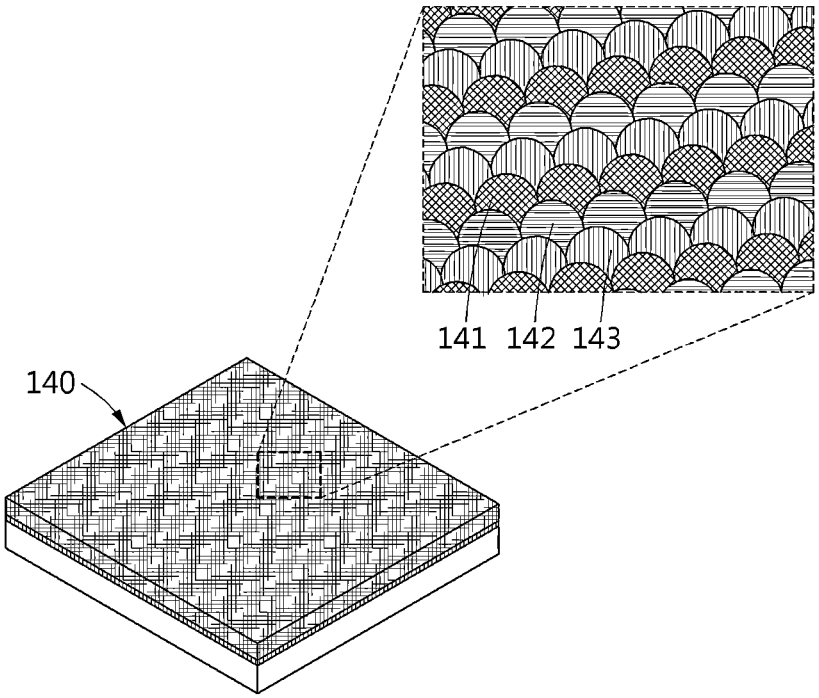

【FIG. 1C】
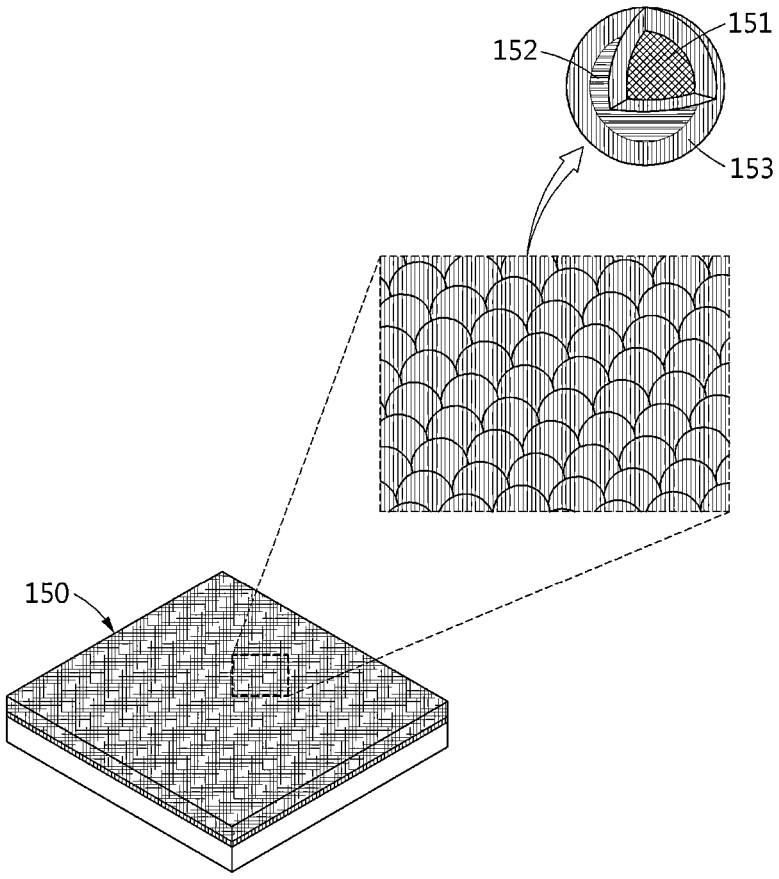

【FIG. 2A】
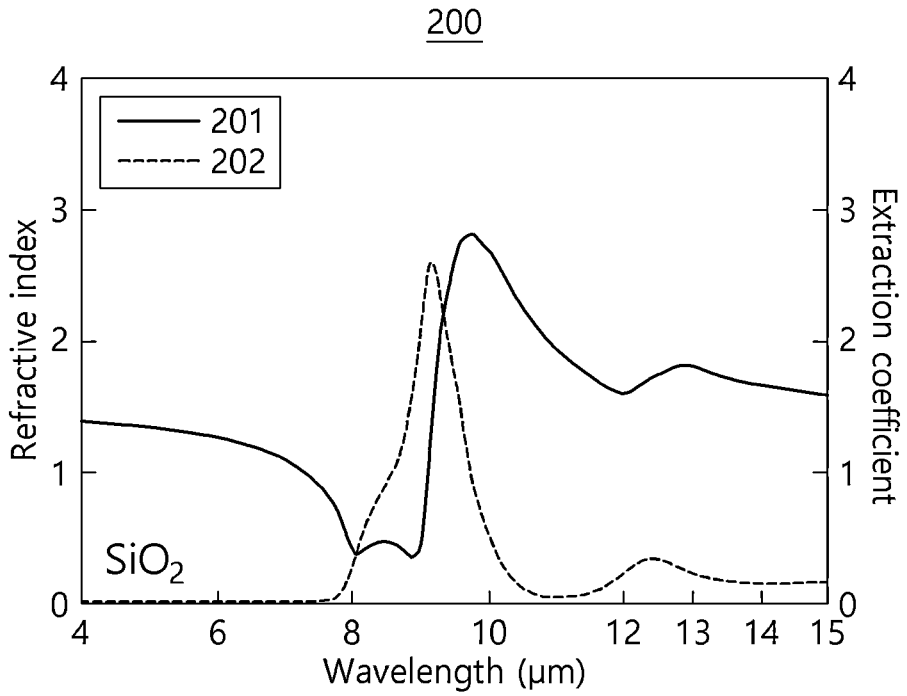

【FIG. 2B】
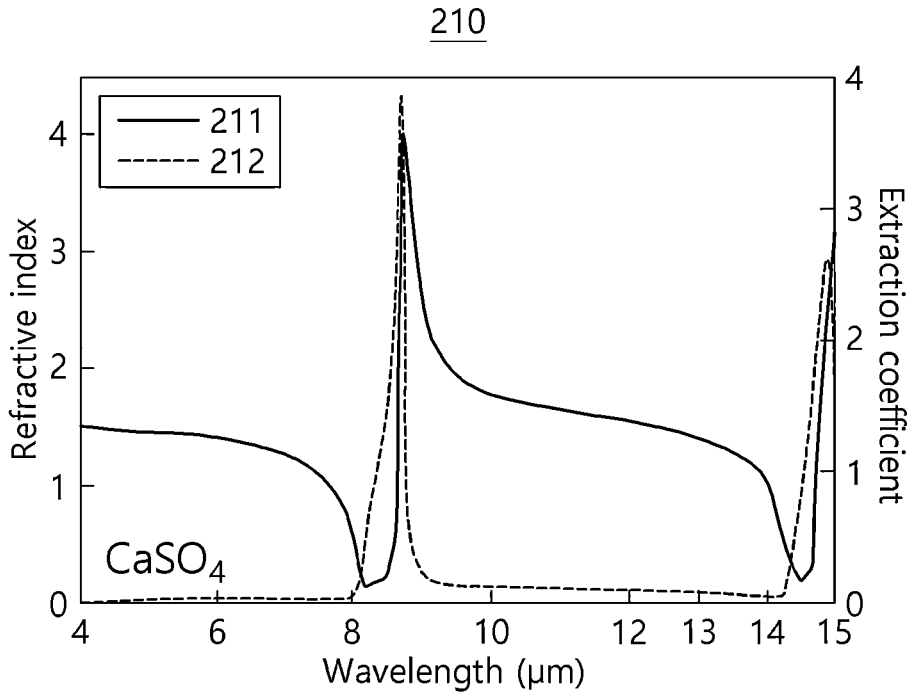

【FIG. 2C】
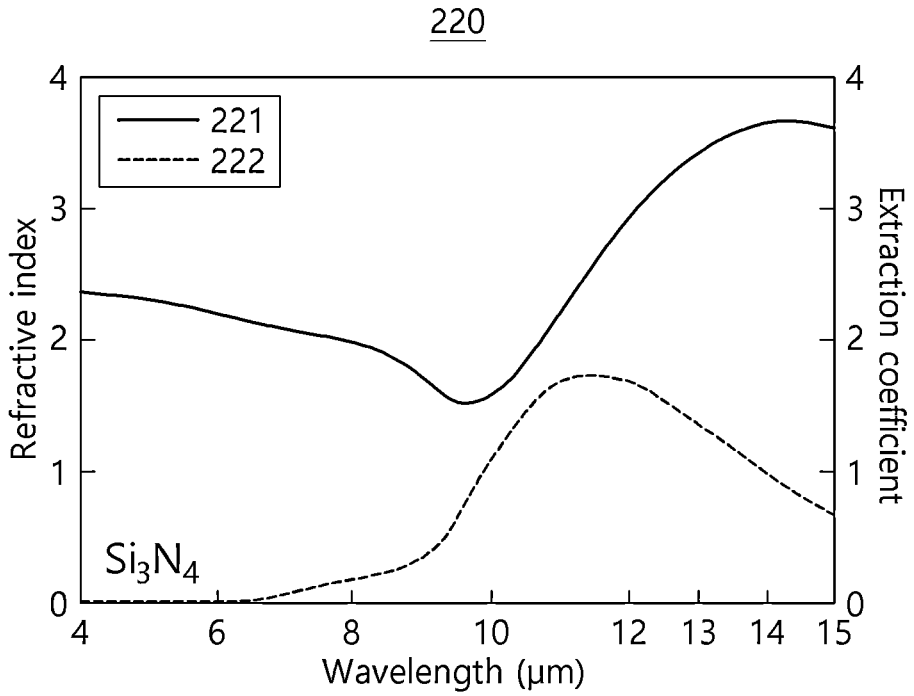

【FIG. 2D】
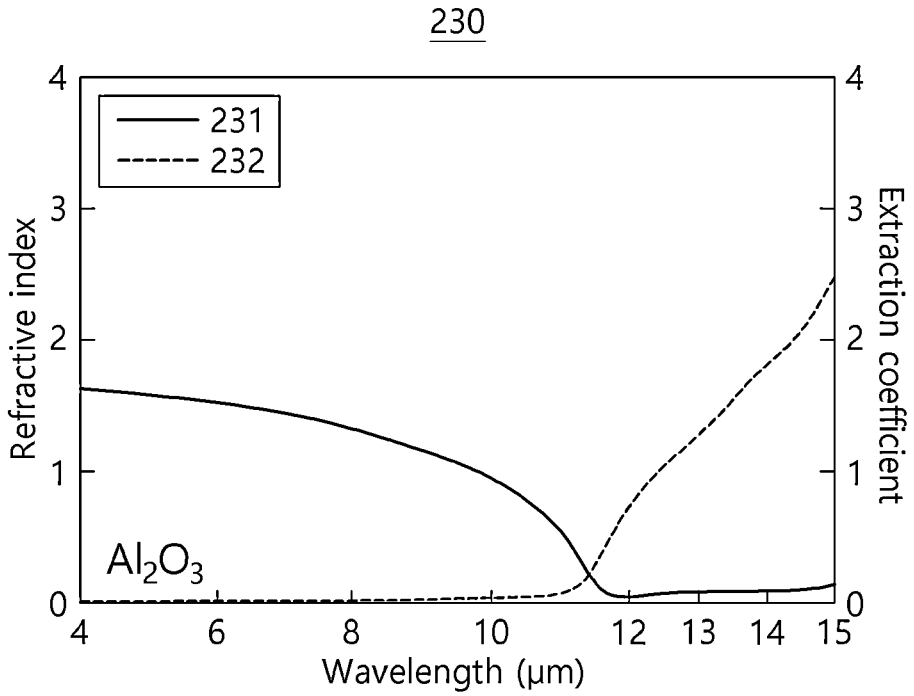

【FIG. 3】
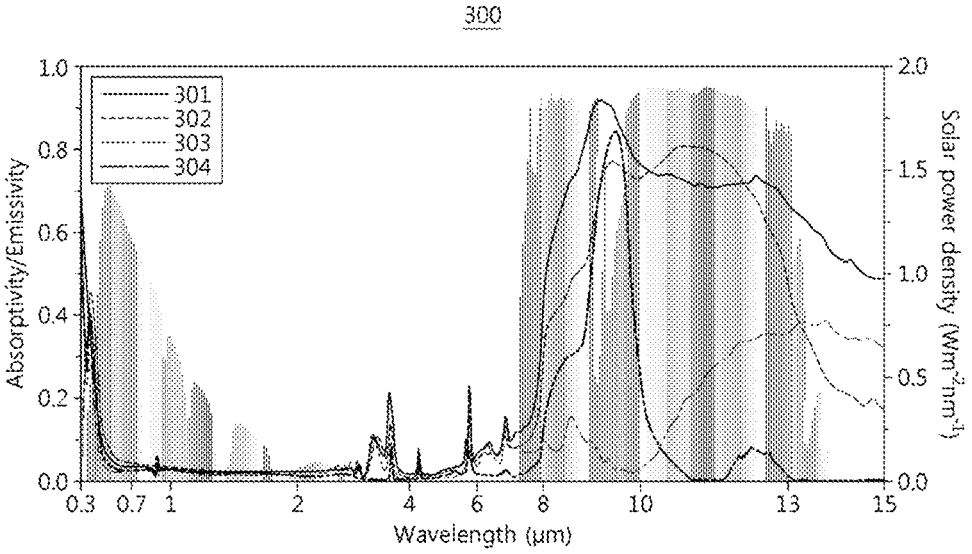

【FIG. 4A】
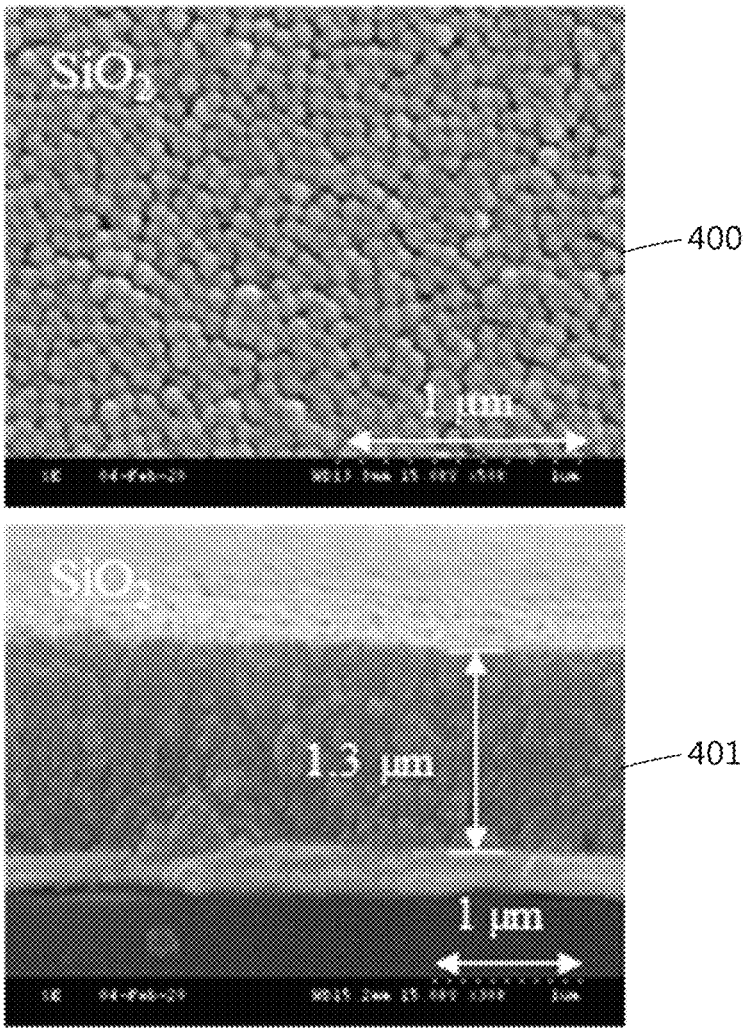

【FIG. 4B】
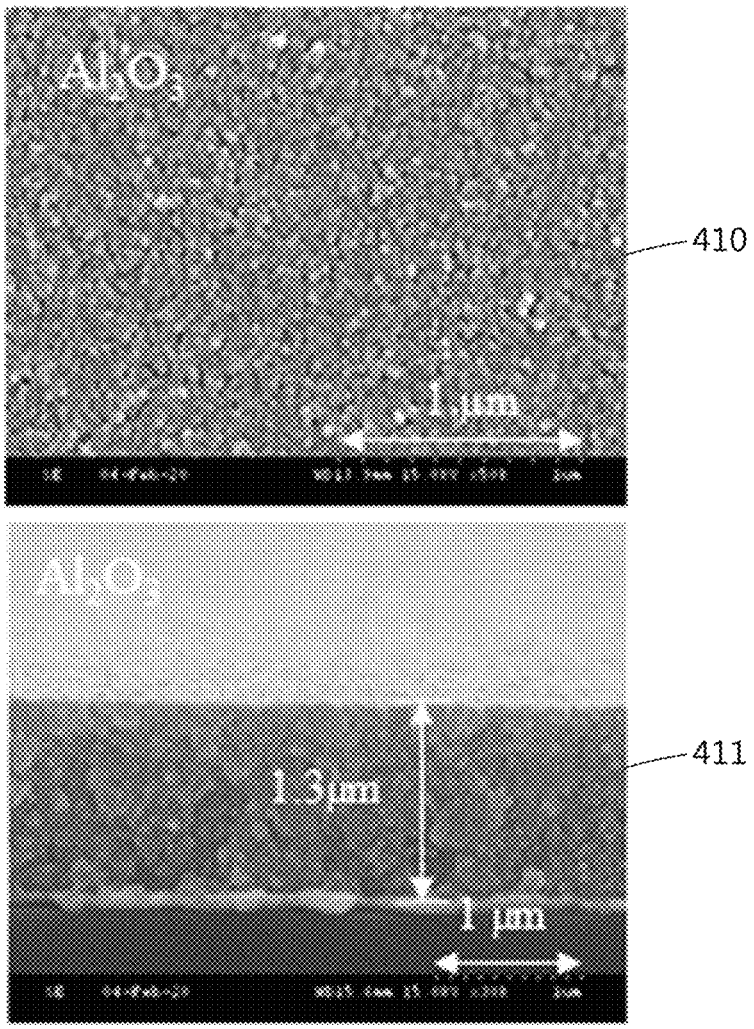

【FIG. 4C】
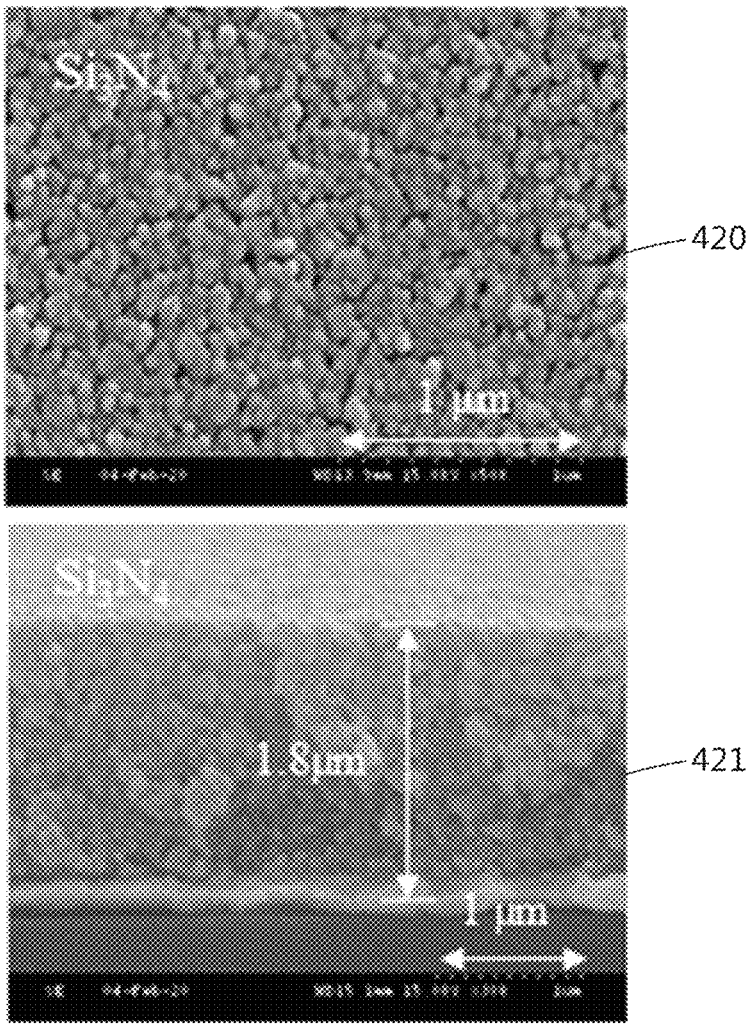

【FIG. 4D】
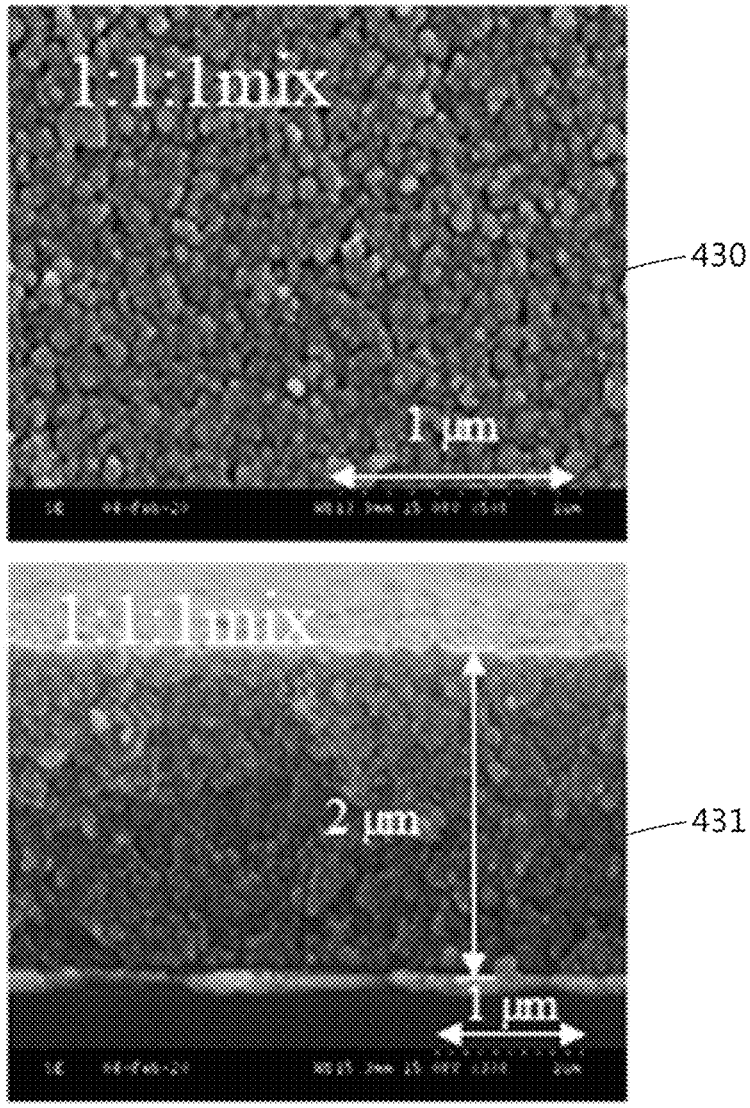

【FIG. 5】
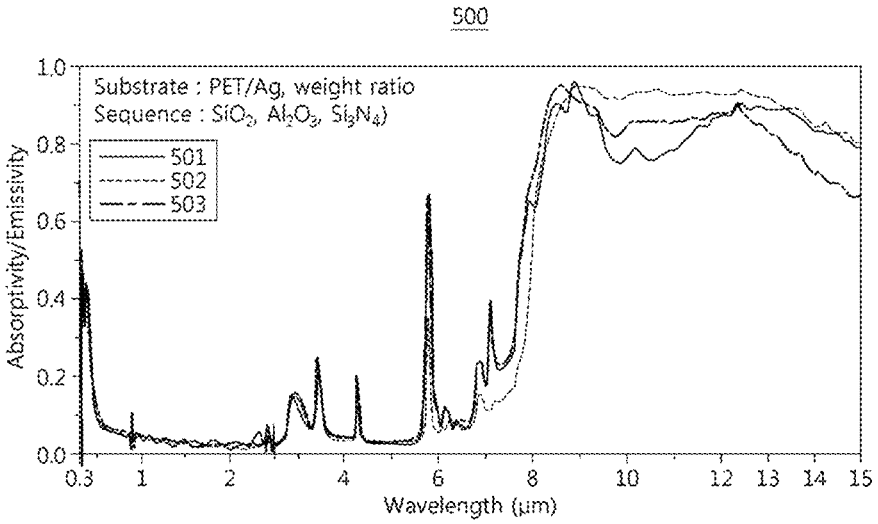

【FIG. 6A】
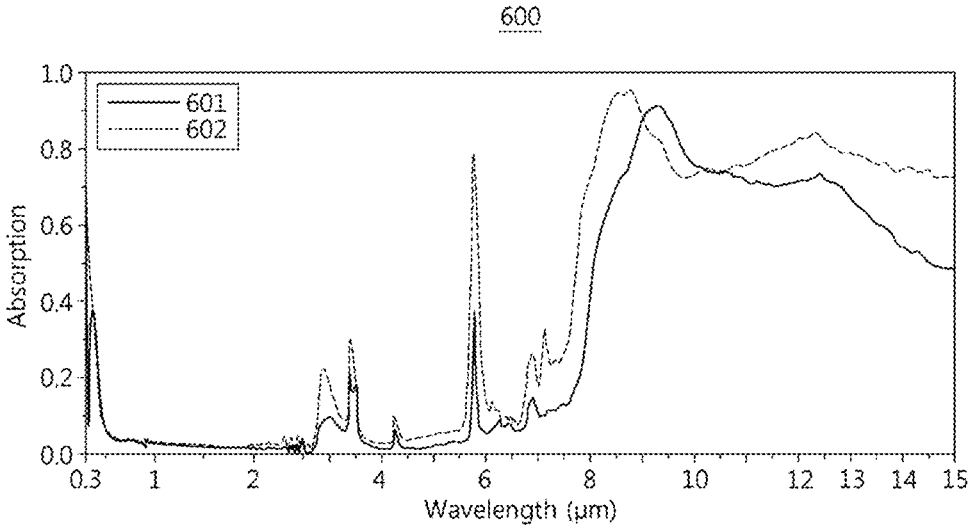

【FIG. 6B】
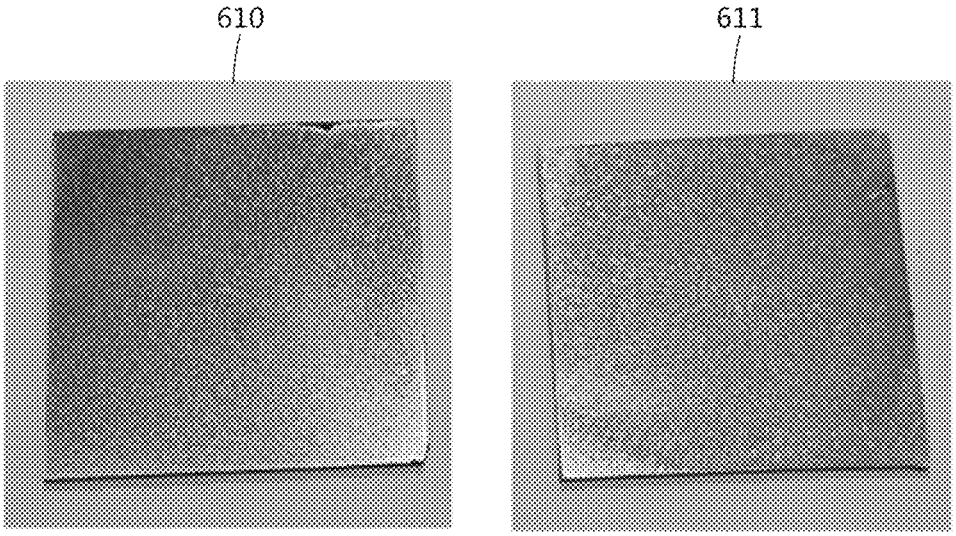

【FIG. 7A】
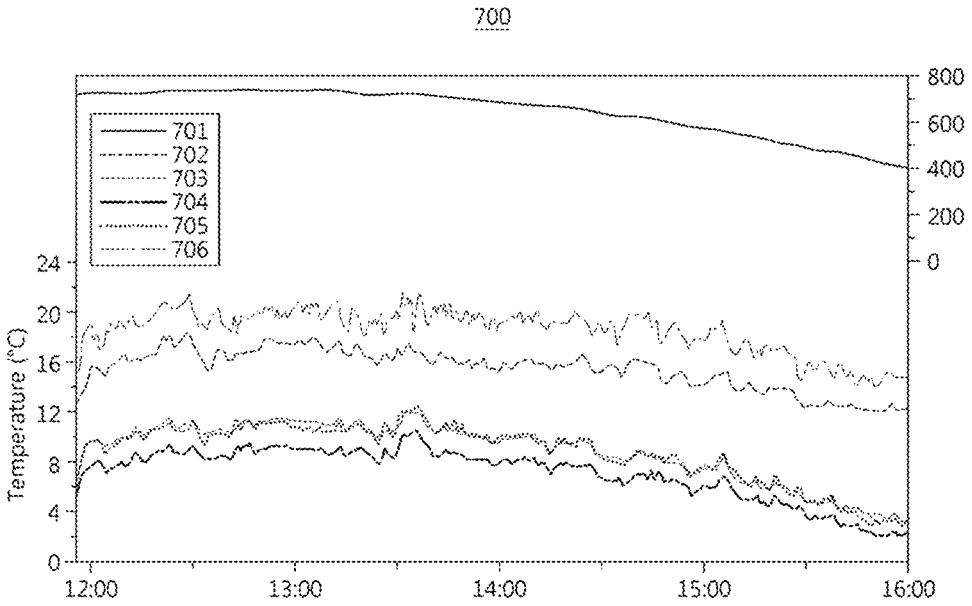

【FIG. 7B】
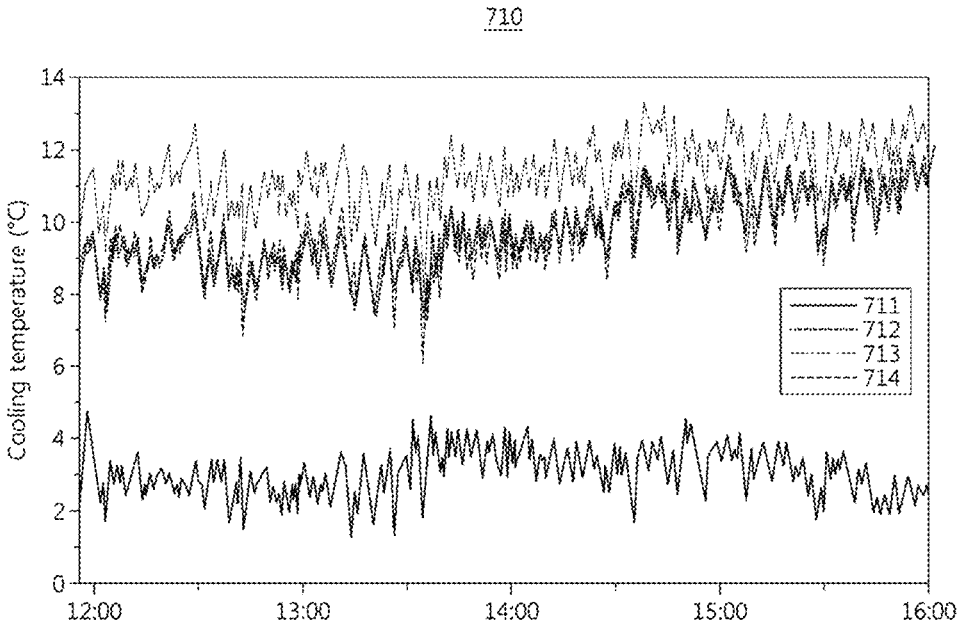

【FIG. 8】
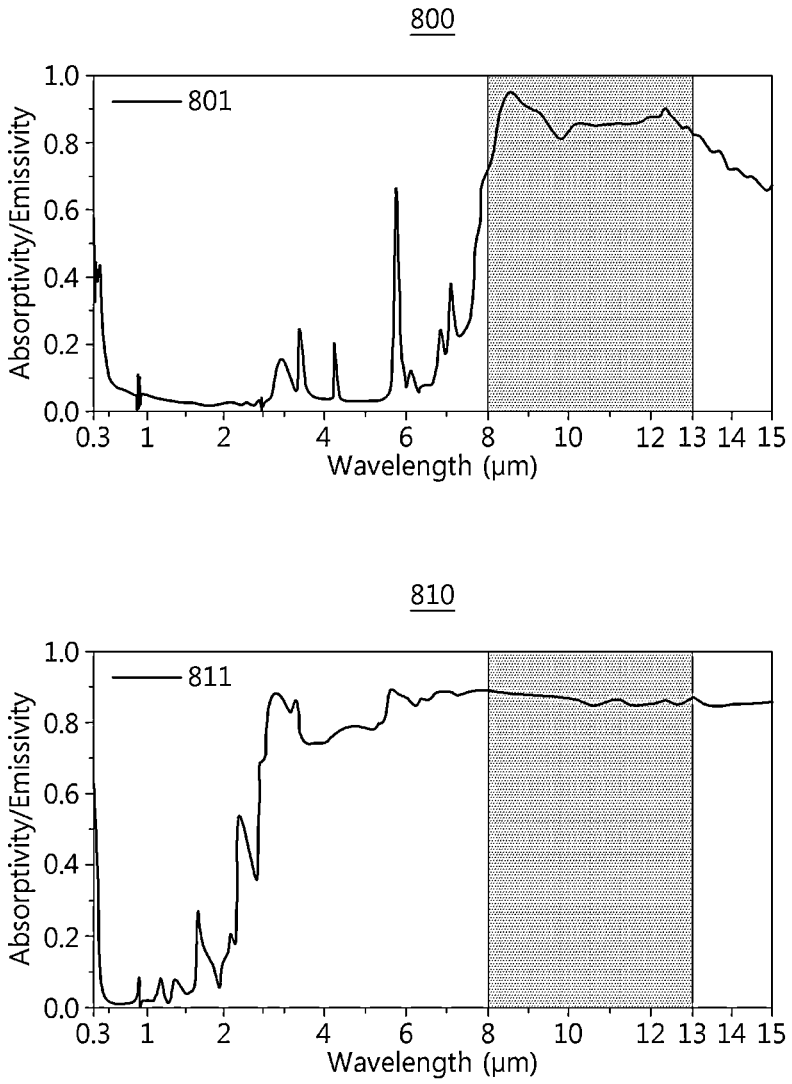

【FIG. 9A】
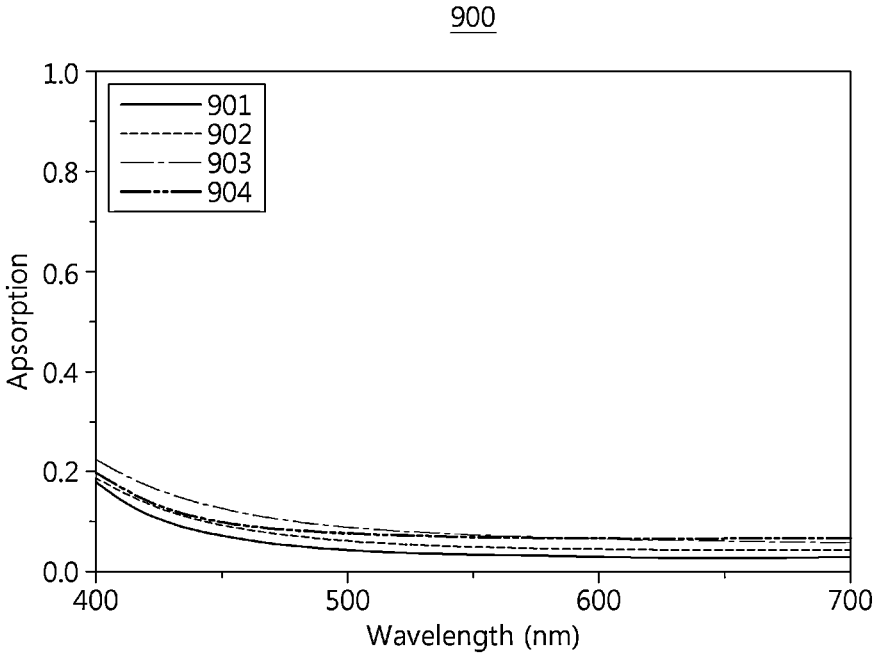

【FIG. 9B】
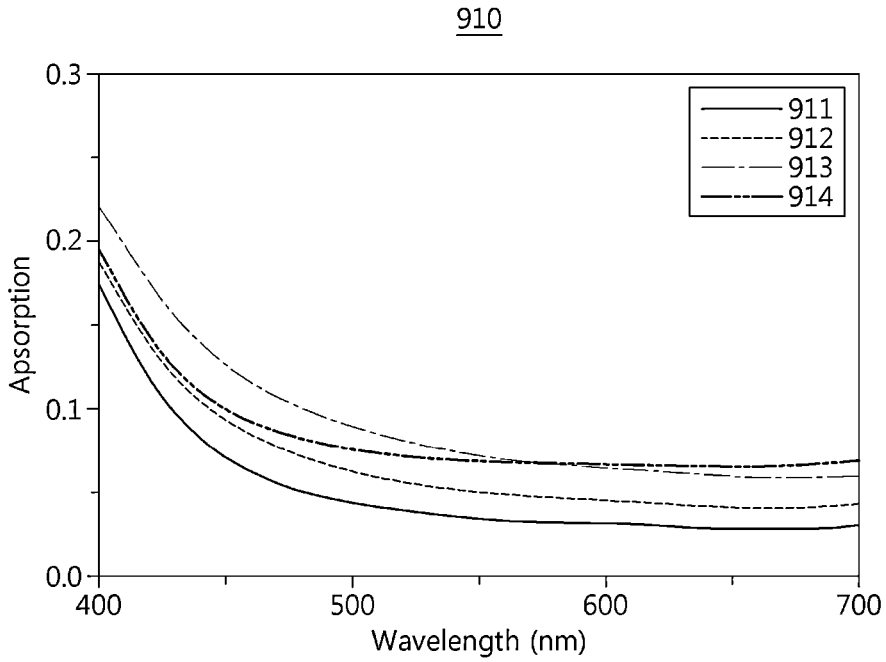

【FIG. 9C】
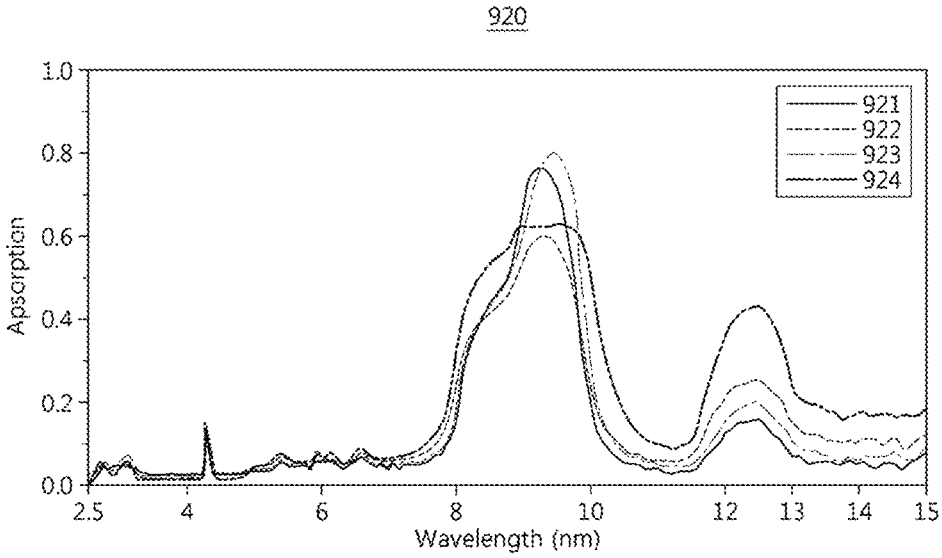

RADIATION COOLING DEVICE USING CERAMIC NANOPARTICLE MIXTURE

CROSS REFERENCE TO RELATED APPLICATIONS

This application is a U.S. National Stage Application of International Application No. PCT/KR2021/004422, filed on Apr. 8, 2021, which claims the benefits under 35 USC 119(a) and 365(b) of Korean Patent Application No. 10-2020-0044215, filed on Apr. 10, 2020 in the Korean Intellectual Property Office, the disclosure of which is incorporated herein by reference for all purposes.

TECHNICAL FIELD

The present invention relates to a technical idea of cooling the surface of a material or the internal temperature under the material by emitting heat under an element to the outside while minimizing absorption of light in the solar spectrum, and more particularly to a technology for developing a material having a high transmittance or high reflectance with respect to incident sunlight and a high absorptivity selectively in a wavelength range of 8 μm to 13 μm corresponding to the sky window section of the atmosphere.

BACKGROUND ART

A passive radiative cooling device can be passively cooled by reflecting the wavelength (0.3 to 2.5 μm) corresponding to sunlight during the day and radiating radiative heat (8 to 13 μm) energy that can escape out of space.

Meanwhile, a passive radiative heating device can be passively heated because it absorbs the wavelength (0.3 to 2.5 μm) corresponding to sunlight during the day and does not well absorb radiative heat (8 to 3 μm) energy that can escape out of space.

The efficiency of a passive cooling device can be confirmed by measuring the optical characteristics of the device itself.

For heat dissipation, a high absorptivity or emissivity in the long-wavelength infrared region is required so that heat can be radiated well into space.

According to the Planck distribution, when the temperature is 300 K, it has a condition for maximally emitting heat in the wavelength range of 6 to 20 μm. In the case of the Earth, the sky window area of the atmosphere is about 8 to 13 μm, so the absorptivity or emissivity in the 8 to 13 μm area should be the maximum to maximize the heat dissipation capability of a passive cooling device.

Infrared radiation in the sky window wavelength range of the atmosphere plays a key role in achieving radiative cooling by substantial heat dissipation. If a wavelength range reflects 100% of the sunlight (emitted from the sun) incident on ultraviolet-visible-near-infrared rays, and 100% of long-wavelength infrared rays in the 8 μm to 13 μm region, which is the sky window section of the atmosphere, can be radiated to the outside, a cooling performance of 158 $W/m^2$ can be realized without energy consumption at an ambient temperature of 300K.

If 95% of sunlight is reflected, 90% or more of mid-infrared radiation in the 8 μm to 13 μm area is radiated to the outside, and the ambient temperature is 300 K, a cooling performance of 100 $W/m^2$ is achieved during the day (i.e., light absorption by the sun exists) can be realized, and a cooling performance of 120 $W/m^2$ can be realized at night when there is no light absorption by the sun.

To be used as a passive radiative cooling material, it should have high transmittance or high reflectance to light, which is incident sunlight, in the UV-vis-NIR wavelength range so as not to absorb incident sunlight, should have high absorptivity (emissivity) for long-wavelength infrared rays in the 8 to 13 μm region which is the sky window section of the atmosphere, and should have high durability (stability, corrosion resistance) in outdoor conditions. In addition, the used material should be cheap and abundant, and it should be possible to form a large area through an inexpensive and easy process.

Polymer materials generally have high absorptivity (emissivity) for long-wavelength infrared rays, but due to the characteristics thereof, they are easily deteriorated by ultraviolet rays and moisture when left outdoors, resulting in a short lifespan.

In the case of using a multi-layer thin film made of an inorganic material (e.g., ceramic material), the lifetime and stability of the material are guaranteed, but a vacuum deposition process is required, which increases the production cost and may limit large-area production.

If there is a material with high absorptivity (emissivity) in the entire area of the sky window section of the atmosphere, and if this material has high stability outdoors, is inexpensive, and can be used for large-area molding, it will be the most ideal passive radiative cooling material. However, in reality, such a material is absent.

DISCLOSURE

Technical Problem

Therefore, the present invention has been made in view of the above problems, and it is one object of the present invention to realize a high emissivity, compared to a polymer-based radiative cooling device, by constituting an infrared radiation layer with a ceramic nanoparticle mixture mixed depending upon a section having a high emissivity partially within the wavelength range corresponding to the sky window of the atmosphere.

It is another object of the present invention to provide a radiative cooling device capable of performing cooling below ambient temperature without consuming energy during day time when sunlight is shining or even during night time when sunlight is not shining, thereby performing a cooling function without energy consumption when applied to the external surface of materials requiring cooling such as buildings and automobiles.

It is still another object of the present invention to improve the energy efficiency of an existing cooling system using energy by being simultaneously applied to the existing cooling system.

It is still another object of the present invention to provide a radiative cooling device applicable to a solution process based on the low unit cost of a ceramic nanoparticle mixture, and as the solution process is possible, applicable to various substrates, such as silicon, glass, as well as inexpensive plastic and metal substrates.

It is yet another object of the present invention to provide a radiative cooling device capable of exhibiting stable radiative cooling properties even when exposed to an external environment for a long time as nanoparticle materials have excellent chemical stability and mechanical properties (strength and hardness) due to the characteristics of the ceramic materials.

Technical Solution

In accordance with an aspect of the present invention, the above and other objects can be accomplished by the provision of a radiative cooling device manufactured using a ceramic nanoparticle mixture, including: a solar reflective layer formed of a metal material to reflect sunlight; and an infrared radiation layer formed by mixing a plurality of ceramic nanoparticles based on any one of a size, thickness, and weight fraction determined in consideration of an absorptivity in a wavelength range corresponding to a sky window of atmosphere and configured to absorb and emit infrared rays in the wavelength range.

The infrared radiation layer may be formed by mixing at least two ceramic nanoparticle types of first ceramic nanoparticles having a first intrinsic emissivity in a first wavelength range, second ceramic nanoparticles having a second intrinsic emissivity in a second wavelength range, and third ceramic nanoparticles having a third intrinsic emissivity in a third wavelength range.

The first wavelength range may include 8 μm to 10 μm in the wavelength range, the second wavelength range may include 10 μm to 12.5 μm in the wavelength range, and the third wavelength range may include 11 μm to 13 μm in the wavelength range.

The first ceramic nanoparticles may include any one ceramic nanoparticle type of $SiO_2$, cBN, and $CaSO_4$ ceramic nanoparticles, the second ceramic nanoparticles may include $Si_3N_4$ ceramic nanoparticles, and the third ceramic nanoparticles may include $Al_2O_3$ ceramic nanoparticles.

The first intrinsic emissivity may include an emissivity higher than an emissivity of the second ceramic nanoparticles and third ceramic nanoparticles in the first wavelength range, the second intrinsic emissivity may include an emissivity higher than an emissivity of the first ceramic nanoparticles and third ceramic nanoparticles in the second wavelength range, and the third intrinsic emissivity may include an emissivity higher than an emissivity of the first ceramic nanoparticles and second ceramic nanoparticles in the third wavelength range.

In the infrared radiation layer, a particle size and composition related to a size and thickness of the plural ceramic nanoparticles may be determined such that an absorptivity of the infrared rays is increased in the wavelength range.

The plural ceramic nanoparticles may include at least two ceramic nanoparticle types of $SiO_2$, $Al_2O_3$, $Si_3N_4$, cBN, $CaSO_4$, $TiO_2$, ALON, $BaTiO_3$, BeO, $Cu_2O$, $MgAl_2O_4$, $SrTiO_3$, $Y_2O_3$, $Bi_{12}SiO_{20}$, $CaCO_3$, $LiTaO_3$, $KNb0_3$, $NaNo_3$, $ZrSiO_4$, and $CaMg(Co_3)_2$.

In the infrared radiation layer, each of the plural ceramic nanoparticles may be included in any one structure of a single particle structure and a multiple core shell structure.

The infrared radiation layer may be formed by single coating a mixed solution, in which the plural ceramic nanoparticles are mixed, on the solar reflective layer by any one method of spin coating, drop coating, bar coating, spray coating, doctor blading, and blade coating.

Any one polymer of polydimethyl siloxane (PDMS), polyurethane acrylate (PUA), polyethylene terephthalate (PET), polyvinyl chloride (PVC), polyvinylidene fluoride (PVDF), and dipentaerythritol hexaacrylate (DPHA) may be added to the infrared radiation layer formed by coating with the mixed solution.

The infrared radiation layer may be formed by mixing the first ceramic nanoparticles, the second ceramic nanoparticles, and the third ceramic nanoparticles in any one weight fraction of 1:1:1, 1:4:1, and 3:6:7.

The solar reflective layer may be formed of at least one metal material selected from silver (Ag), aluminum (Al), gold (Au), copper (Cu), titanium (Ti), chromium (Cr), manganese (Mn), iron (Fe), and platinum (Pt) or any one material of alloy materials in which at least two of the metal materials are combined.

Advantageous Effects

The present invention can realize a high emissivity, compared to a polymer-based radiative cooling device, by constituting an infrared radiation layer with a ceramic nanoparticle mixture mixed depending upon a section having a high emissivity partially within the wavelength range corresponding to the sky window of the atmosphere.

The present invention can perform cooling below ambient temperature without consuming energy during day time when sunlight is shining or even during night time when sunlight is not shining, thereby performing a cooling function without energy consumption when applied to the external surface of materials requiring cooling such as buildings and automobiles.

The present invention can improve the energy efficiency of an existing cooling system using energy by being simultaneously applied to the existing cooling system.

The present invention can provide a radiative cooling device applicable to a solution process based on the low unit cost of a ceramic nanoparticle mixture, and as the solution process is possible, applicable to various substrates, such as silicon, glass, as well as inexpensive plastic and metal substrates.

The present invention can exhibit stable radiative cooling properties even when exposed to an external environment for a long time as nanoparticle materials have excellent chemical stability and mechanical properties (strength and hardness) due to the characteristics of the ceramic materials.

DESCRIPTION OF DRAWINGS

FIGS. 1A to 1C illustrate components of a radiative cooling device manufactured using a ceramic nanoparticle mixture according to an embodiment of the present invention.

FIGS. 2A to 2D illustrate the intrinsic emissivity of ceramic nanoparticles according to an embodiment of the present invention.

FIG. 3 illustrates the emissivity of a radiative cooling device manufactured using a ceramic nanoparticle mixture according to an embodiment of the present invention.

FIGS. 4A to 4D illustrate electron beam microscopic images of films formed of ceramic nanoparticle solutions according to an embodiment of the present invention.

FIG. 5 illustrates the emissivity of radiative cooling devices manufactured while varying the weight fraction of a ceramic nanoparticle mixture according to an embodiment of the present invention.

FIGS. 6A and 6B illustrate radiative cooling devices manufactured using ceramic nanoparticle mixtures to which a polymer is added according to embodiments of the present invention.

FIGS. 7A and 7B illustrate external temperature measurement data of radiative cooling devices manufactured using ceramic nanoparticle mixtures having different weight fractions according to embodiments of the present invention.

FIG. 8 illustrates the optical characteristics of a radiative cooling device manufactured using a ceramic nanoparticle mixture according to an embodiment of the present invention and a polymer-based radiative cooling device.

FIGS. 9A to 9C illustrate the optical characteristics of a radiative cooling device dependent upon the size of particles in a ceramic nanoparticle mixture according to an embodiment of the present invention.

BEST MODE

The embodiments will be described in detail herein with reference to the drawings.

However, it should be understood that the present disclosure is not limited to the embodiments according to the concept of the present disclosure, but includes changes, equivalents, or alternatives falling within the spirit and scope of the present disclosure.

In the following description of the present disclosure, a detailed description of known functions and configurations incorporated herein will be omitted when it may make the subject matter of the present disclosure unclear.

The terms used in the specification are defined in consideration of functions used in the present disclosure, and can be changed according to the intent or conventionally used methods of clients, operators, and users. Accordingly, definitions of the terms should be understood on the basis of the entire description of the present specification.

In description of the drawings, like reference numerals may be used for similar elements.

The singular expressions in the present specification may encompass plural expressions unless clearly specified otherwise in context.

In this specification, expressions such as "A or B" and "at least one of A and/or B" may include all possible combinations of the items listed together.

Expressions such as "first" and "second" may be used to qualify the elements irrespective of order or importance, and are used to distinguish one element from another and do not limit the elements.

It will be understood that when an element (e.g., first) is referred to as being "connected to" or "coupled to" another element (e.g., second), it may be directly connected or coupled to the other element or an intervening element (e.g., third) may be present.

As used herein, "configured to" may be used interchangeably with, for example, "suitable for", "ability to", "changed to", "made to", "capable of", or "designed to" in terms of hardware or software.

In some situations, the expression "device configured to" may mean that the device "may do ~" with other devices or components.

For example, in the sentence "processor configured to perform A, B, and C", the processor may refer to a general-purpose processor (e.g., CPU or application processor) capable of performing corresponding operation by running a dedicated processor (e.g., embedded processor) for performing the corresponding operation, or one or more software programs stored in a memory device.

In addition, the expression "or" means "inclusive or" rather than "exclusive or". That is, unless otherwise mentioned or clearly inferred from context, the expression "x uses a or b" means any one of natural inclusive permutations.

Terms, such as "unit" or "module", etc., should be understood as a unit that processes at least one function or operation and that may be embodied in a hardware manner, a software manner, or a combination of the hardware manner and the software manner.

FIGS. 1A to 1C illustrate components of a radiative cooling device manufactured using a ceramic nanoparticle mixture according to an embodiment of the present invention.

FIG. 1A illustrates a laminated structure of a radiative cooling device manufactured using a ceramic nanoparticle mixture according to an embodiment of the present invention.

Referring to FIG. 1A, a radiative cooling device 100 manufactured using a ceramic nanoparticle mixture according to an embodiment of the present invention may include a typical layer 110, and a solar reflective layer 120 and infrared radiation layer 130 formed on the typical layer 110. Hereinafter, for convenience of description, the radiative cooling device 100 manufactured using a ceramic nanoparticle mixture is referred to as a radiative cooling device.

For example, the radiative cooling device 100 includes the solar reflective layer 120 and the infrared radiation layer 130.

The solar reflective layer 120 according to an embodiment of the present invention is formed of a metal material to reflect sunlight.

For example, the solar reflective layer 120 may be formed of at least one metal material selected from silver (Ag), aluminum (Al), gold (Au), copper (Cu), titanium (Ti), chromium (Cr), manganese (Mn), iron (Fe), and platinum (Pt) or any one material of alloy materials in which at least two of the metal materials are combined.

That is, the solar reflective layer 120 may be formed of at least one metal material selected from silver (Ag), aluminum (Al), gold (Au), copper (Cu), titanium (Ti), chromium (Cr), manganese (Mn), iron (Fe), and platinum (Pt).

In addition, the solar reflective layer 120 may be formed of an alloy material in which at least two of silver (Ag), aluminum (Al), gold (Au), copper (Cu), titanium (Ti), chromium (Cr), manganese (Mn), iron (Fe), and platinum (Pt) are combined.

For example, the solar reflective layer 120 may be formed by coating at least one metal material selected from silver (Ag), aluminum (Al), gold (Au), copper (Cu), titanium (Ti), chromium (Cr), manganese (Mn), iron (Fe), and platinum (Pt) or any one material of alloy materials, in which at least two of the metal materials are combined, on any one substrate of glass, a plastic film, and a metal plate which corresponds to the typical layer 110.

The infrared radiation layer 130 according to an embodiment of the present invention may be formed by mixing a plurality of ceramic nanoparticles based on any one of a size, thickness, and weight fraction determined in consideration of absorptivity in a wavelength range corresponding to the sky window of the atmosphere and may absorb and radiate infrared rays in the wavelength range.

For example, the wavelength range corresponding to the sky window of the atmosphere includes a wavelength range of 8 μm to 13 μm.

For example, in the infrared radiation layer 130, the particle size and composition related to the size and thickness of the plural ceramic nanoparticles may be determined so that the absorptivity of infrared rays is increased in the wavelength range corresponding to the sky window of the atmosphere.

For example, the infrared radiation layer 130 may be formed using a mixture, in which the plural ceramic nanoparticles are mixed, after the particle size and composition of each of the plural ceramic nanoparticles is adjusted to have a high emissivity in the wavelength range corresponding to the sky window of the atmosphere.

For example, in the infrared radiation layer 130, each of the plural ceramic nanoparticles may be included in any one of a single particle structure and a multiple core-shell structure.

Therefore, the present invention enables a solution process based on the low unit cost of the ceramic nanoparticle mixture, and as the solution process is possible, it is possible to provide a radiative cooling device applicable to various substrates, such as silicon, glass, as well as inexpensive plastic and metal substrates.

The single particle structure will be further described with reference to FIG. 1B and the multiple core-shell structure will be further described with reference to FIG. 1C.

In accordance with an embodiment of the present invention, the infrared radiation layer 130 may be formed by coating a mixed solution, in which the plural ceramic nanoparticles are mixed, on the solar reflective layer 120 by one single coating method of spin coating, drop coating, bar coating, spray coating, doctor blading, and blade coating.

FIG. 1B exemplifies a case wherein plural ceramic nanoparticles in the infrared radiation layer of the radiative cooling device manufactured using the ceramic nanoparticle mixture according to an embodiment of the present invention are mixed in a single particle structure.

Referring to FIG. 1B, in an infrared radiation layer 140 of the radiative cooling device manufactured using a ceramic nanoparticle mixture according to an embodiment of the present invention, a plurality of ceramic nanoparticles are mixed in a single particle structure.

In accordance with an embodiment of the present invention, in the infrared radiation layer 140, each nanoparticle type of first ceramic nanoparticles 141, second ceramic nanoparticles 142, and third ceramic nanoparticles 143 among the plural ceramic nanoparticles is mixed in a single particle structure to form a nanoparticle mixture layer on a solar reflective layer.

For example, each nanoparticle type of the first ceramic nanoparticles 141, the second ceramic nanoparticles 142, and the third ceramic nanoparticles 143 may be single coated by any one method of spin coating, drop coating, bar coating, spray coating, doctor blading, and blade coating.

For example, the arrangement order of the first ceramic nanoparticles 141, the second ceramic nanoparticles 142, and the third ceramic nanoparticles 143 may be arbitrarily changed.

For example, the first ceramic nanoparticles 141 may include any one ceramic nanoparticle type of $SiO_2$, cBN and $CaSO_4$, the second ceramic nanoparticles 142 may include $Si_3N_4$ ceramic nanoparticles, and the third ceramic nanoparticles 143 may include $Al_2O_3$ ceramic nanoparticles.

FIG. 1C exemplifies a case wherein a plurality of plural ceramic nanoparticles in an infrared radiation layer of the radiative cooling device manufactured using a ceramic nanoparticle mixture according to an embodiment of the present invention are mixed in a multiple core-shell structure.

Referring to FIG. 1C, in an infrared radiation layer 150 of the radiative cooling device manufactured using a ceramic nanoparticle mixture according to an embodiment of the present invention, the plural ceramic nanoparticles are mixed in a multiple core-shell structure.

Each nanoparticle type of first ceramic nanoparticles 151, second ceramic nanoparticles 152, and third ceramic nanoparticles 153 of the plural ceramic nanoparticles may be mixed in a multiple core-shell structure to form a nanoparticle mixture layer on the solar reflective layer.

For example, each nanoparticle type of the first ceramic nanoparticles 151, the second ceramic nanoparticles 152, and the third ceramic nanoparticles 153 may be sequentially coated from the core thereof by any one method of spin coating, drop coating, bar coating, spray coating, doctor blading, and blade coating, and the coating order of the first ceramic nanoparticles 151, the second ceramic nanoparticles 152, and the third ceramic nanoparticles 153 may be arbitrarily changed.

For example, the first ceramic nanoparticles 151 may include any one ceramic nanoparticle type of $SiO_2$, cBN, and $CaSO_4$, the second ceramic nanoparticles 152 may include $Si_3N_4$ ceramic nanoparticles, and the third ceramic nanoparticles 153 may include $Al_2O_3$ ceramic nanoparticles.

FIGS. 2A to 2D illustrate the intrinsic emissivity of ceramic nanoparticles according to an embodiment of the present invention.

FIG. 2A illustrates the refractive index and extraction coefficient of $SiO_2$, FIG. 2B illustrates the refractive index and extraction coefficient of $CaSO_4$, FIG. 2C illustrates the refractive index and extraction coefficient of $Si_3N_4$, and FIG. 2D illustrates the refractive index and extraction coefficient of $Al_2O_3$.

Referring to a graph 200 of FIG. 2A, a refractive index 201 and an extraction coefficient 202 are shown as a measurement index for $SiO_2$, an absorptivity of infrared rays for infrared radiation is related to an extraction coefficient 202, and an extraction coefficient 202 of $SiO_2$ is measured as high between 8 μm to 10 μm.

Referring to a graph 210 of FIG. 2B, a refractive index 211 and an extraction coefficient 212 are shown as a measurement index for $CaSO_4$, an absorptivity of infrared rays for infrared radiation is related to an extraction coefficient 212, and an extraction coefficient 212 of $CaSO_4$ is measured as high between 8 μm to 9.5 μm.

Referring to a graph 220 of FIG. 2C, a refractive index 221 and an extraction coefficient 222 are shown as a measurement index for $Si_3N_4$, an absorptivity of infrared rays for infrared radiation is related to an extraction coefficient 222, and an extraction coefficient 222 of $Si_3N_4$ is measured as high between 10 μm to 13 μm.

Referring to a graph 230 of FIG. 2D, a refractive index 231 and an extraction coefficient 232 are shown as a measurement index for $Al_2O_3$, an absorptivity of infrared rays for infrared radiation is related to an extraction coefficient 232, and an extraction coefficient 232 of $Al_2O_3$ is measured to be high after 12 μm.

In accordance with an embodiment of the present invention, the infrared radiation layer may be formed by mixing at least two ceramic nanoparticle types of first ceramic nanoparticles having a first intrinsic emissivity in a first wavelength range, second ceramic nanoparticles having a second intrinsic emissivity in a second wavelength range, and third ceramic nanoparticles having a third intrinsic emissivity in a third wavelength range.

For example, the first wavelength range may include a wavelength range of 8 μm to 10 μm, the second wavelength range may include a wavelength range of 10 μm to 12.5 μm, and the third wavelength range may include a wavelength range of 11 μm to 13 μm.

For example, the first ceramic nanoparticles may include any one ceramic nanoparticle type of $SiO_2$, cBN, and $CaSO_4$, the second ceramic nanoparticles may include $Si_3N_4$ ceramic nanoparticles, and the third ceramic nanoparticles may include $Al_2O_3$ ceramic nanoparticles.

The first intrinsic emissivity may include an emissivity higher than the emissivity of the second ceramic nanoparticles and the third ceramic nanoparticles in the first wavelength range.

In addition, the second intrinsic emissivity may include an emissivity higher than the emissivity of the first ceramic nanoparticles and the third ceramic nanoparticles in the second wavelength range.

In addition, the third intrinsic emissivity may include an emissivity higher than the emissivity of the first ceramic nanoparticles and the second ceramic nanoparticles in the third wavelength range.

Therefore, when a plurality of ceramic nanoparticles among $SiO_2$, $Al_2O_3$, $Si_3N_4$, cBN, and $CaSO_4$ are mixed and formed on the solar reflective layer to form the infrared radiation layer in accordance with an embodiment of the present invention, any one ceramic nanoparticle type of $SiO_2$, cBN, and $CaSO_4$ having an emissivity higher than the emissivity of $Al_2O_3$ and $Si_3N_4$ in 8 μm to 10 μm in a wavelength range corresponding to the sky window of the atmosphere, $Si_3N_4$ nanoparticles having an emissivity higher than the emissivity of $SiO_2$, $Al_2O_3$, cBN, and $CaSO_4$ in a wavelength range of 10 μm to 12.5 μm, and $Al_2O_3$ nanoparticles having an emissivity higher than the emissivity of $SiO_2$, cBN, $CaSO_4$, and $Si_3N_4$ in a wavelength range of 11 μm to 13 μm are mixed and formed.

In addition, the infrared radiation layer may be formed such that the emissivity of any one ceramic nanoparticle type of $SiO_2$, cBN, and $CaSO_4$, the emissivity of $Si_3N_4$ nanoparticles, and the emissivity of $Al_2O_3$ nanoparticles overlap within the wavelength range corresponding to the sky window of the atmosphere.

Therefore, since the infrared radiation layer of the present invention is constituted using a ceramic nanoparticle mixture mixed depending upon a section having a high emissivity partially within the wavelength range corresponding to the sky window of the atmosphere, the present invention can realize a high emissivity compared to a polymer-based radiative cooling device.

FIG. 3 illustrates the emissivity of a radiative cooling device manufactured using a ceramic nanoparticle mixture according to an embodiment of the present invention.

FIG. 3 illustrates a comparison of the absorptivity of the radiative cooling device manufactured using a ceramic nanoparticle mixture according to an embodiment of the present invention and a wavelength range-dependent absorptivity of each of $SiO_2$, $Al_2O_3$, and $Si_3N_4$ nanoparticle films.

Referring to a graph 300 of FIG. 3, the graph 300 illustrates an absorptivity (emissivity) change dependent upon a change in a wavelength and the intensity of sunlight and shows a first absorptivity 301, a second absorptivity 302, a third absorptivity 303, and a fourth absorptivity 304. The first absorptivity 301 shows an absorptivity of a radiative cooling device whose solar reflective layer is coated with $SiO_2$, the second absorptivity 302 shows an absorptivity of a radiative cooling device whose solar reflective layer is coated with $Al_2O_3$, the third absorptivity 303 shows an absorptivity of a radiative cooling device whose solar reflective layer is coated with $Si_3N_4$, and the fourth absorptivity 304 shows an absorptivity of a radiative cooling device manufactured using a ceramic nanoparticle mixture.

Comparing the first absorptivity 301 to the fourth absorptivity 304, the second absorptivity 302 shows a high absorption between 11 μm to 13 μm, the third absorptivity 303 shows a high absorption between 9 μm to 12 μm, the first absorptivity 301 shows a high absorption between 9 μm to 10 μm, and the fourth absorptivity 304 shows a high absorption between 8 μm to 13 μm that correspond to the sky window of the atmosphere due to the overlap of the optical characteristics of respective materials. Average absorption and average emissivity related to the graph 300 are summarized in Table 1 below.

For example, the ceramic nanoparticle mixture may include $SiO_2$, $Al_2O_3$, and $Si_3N_4$ mixed in a weight fraction of 1:1:1.

TABLE 1

| Materials | Average absorptivity (0.3 μm to 2.5 μm) | Average emissivity (8 μm to 13 μm) |
|---|---|---|
| $SiO_2$ | 0.0438 | 0.2200 |
| $Al_2O_3$ | 0.0386 | 0.1735 |
| $Si_3N_4$ | 0.0532 | 0.6746 |
| Mixture (weight fraction 1:1:1) | 0.0427 | 0.7410 |

As the first absorptivity 301 to the fourth absorptivity 304 exhibit a relatively low average absorptivity in an incident sunlight wavelength range corresponding to 0.3 μm to 2.5 μm, it can be confirmed that less energy of incident sunlight is absorbed and radiative cooling is possible at day time.

When the first absorptivity 301 to the fourth absorptivity 304 are compared with each other, the average emissivity (absorptivity) of the mixture corresponding to the fourth absorptivity 304 is relatively high compared to other materials.

However, the mixture has an average emissivity (absorptivity) of only about 74% in the sky window section of the atmosphere, which may mean that radiative cooling does not occur sufficiently through the sky window region of the atmosphere. By adjusting the particle size, mixture ratio, and film thickness of each of the nanoparticle types, it is possible to increase an average emissivity (absorptivity) in the sky window section of the atmosphere while maintaining a relatively low average absorptivity in the incident sunlight wavelength range.

FIGS. 4A to 4D illustrate electron beam microscopic images of films formed of ceramic nanoparticle solutions according to an embodiment of the present invention.

FIG. 4A illustrates an electron beam microscopic image of a $SiO_2$ film, FIG. 4B illustrates an electron beam microscopic image of an $Al_2O_3$ film, FIG. 4C illustrates an electron beam microscopic image of a $Si_3N_4$ film, and FIG. 4D illustrates an electron beam microscopic image of a film formed of a ceramic nanoparticle mixture according to an embodiment of the present invention.

For example, the ceramic nanoparticle mixture may include a mixture of $SiO_2$, $Al_2O_3$, and $Si_3N_4$ mixed in a weight fraction of 1:1:1.

Referring to FIG. 4A, an image 400 illustrates particles of $SiO_2$ film, and an image 401 illustrates the laminated structure of $SiO_2$ film. As shown in the image 401, the $SiO_2$ film may be laminated to a thickness of about 1.3 μm.

Referring to FIG. 4B, an image 410 illustrates particles of $Al_2O_3$ film, and an image 411 illustrates the laminated structure of $Al_2O_3$ film. As shown in the image 411, $Al_2O_3$ film may be laminated to a thickness of about 1.3 μm.

Referring to FIG. 4C, an image 420 illustrates particles of $Si_3N_4$ film, and an image 421 illustrates the laminated structure of $Si_3N_4$ film 의 a laminated structure. As shown in the image 421, the $Si_3N_4$ film may be laminated to a thickness of about 1.8 μm.

As shown in each of the image 400, the image 410, and the image 420, each nanoparticle type may be formed in a film shape by spin coating with ethanol as a solvent at a concentration of 20 wt %.

For example, the solvent includes any one of ethanol, water, hexane, propylene glycol methyl ether acetate (PGMEA), propylene glycol methyl ether (PGME), and methyl isobutyl ketone (MIBK).

For example, as the solvent is highly volatile, a film may be formed by performing spin coating, after respective ceramic nanoparticles are dispersed, by using the solvent that evaporates in a short time.

Referring to FIG. 4D, an image 430 illustrates particles of a film manufactured using a ceramic nanoparticle mixture, and an image 431 illustrates a laminated structure of the film manufactured using the ceramic nanoparticle mixture. As shown in the image 431, the film manufactured using the ceramic nanoparticle mixture may be laminated to a thickness of about 2 μm.

In the case of the ceramic nanoparticle mixtures shown in the image 430 and the image 431, respective nanoparticles may be formed in a film shape by spin coating with ethanol as a solvent at a concentration of 6.67 wt %.

FIG. 5 illustrates the emissivity of radiative cooling devices manufactured while varying the weight fraction of a ceramic nanoparticle mixture according to an embodiment of the present invention.

FIG. 5 compares and illustrates average absorption and average emissivity in the incident sunlight wavelength range and the sky window wavelength range of the atmosphere while adjusting the weight fraction of ceramic nanoparticles used to prepare a ceramic nanoparticle mixture.

Referring to FIG. 5, a graph 500 illustrates an absorbance (emissivity) change according to a change in wavelength and shows a first absorptivity 501, a second absorptivity 502, and a third absorptivity 503. The first absorptivity 501 illustrates an absorptivity when $SiO_2$, $Al_2O_3$, and $Si_3N_4$ ceramic nanoparticles are mixed in a weight fraction of 1:1:1, the second absorptivity 502 illustrates an absorptivity when $SiO_2$, $Al_2O_3$, and $Si_3N_4$ ceramic nanoparticles are mixed in a weight fraction of 1:4:1, and the third absorptivity 503 illustrates an absorptivity when $SiO_2$, $Al_2O_3$, and $Si_3N_4$ ceramic nanoparticles are mixed in a weight fraction of 3:6:7.

When the first absorptivity 501 to the third absorptivity 503 of the graph 500 are compared with each other, the third absorptivity 503 of the infrared radiation layer formed using a mixture of $SiO_2$, $Al_2O_3$, and $Si_3N_4$ ceramic nanoparticles mixed in a weight fraction of 3:6:7 exhibits a relatively high infrared emissivity.

Table 2 below shows numerical data of average absorptivity and average emissivity in relation to the first absorptivity 501 to the third absorptivity 503 of the graph 500.

TABLE 2

| Weight fraction of materials ($SiO_2$:$Al_2O_3$:$Si_3N_4$) | Average absorptivity (0.3 μm to 2.5 μm) | Average emissivity (8 μm to 13 μm) |
|---|---|---|
| 1:1:1 | 0.062 | 0.868 |
| 1:4:1 | 0.059 | 0.832 |
| 3:6:7 | 0.052 | 0.911 |

According to the graph 500 and Table 2, it can be optimized to have low absorptivity in the solar spectrum and high emissivity in the sky window of the atmosphere by controlling parameters such as the size of nanoparticles of each of $SiO_2$, $Al_2O_3$, and $Si_3N_4$, the weight fraction thereof, a final nanoparticles layer thickness, and material selection.

In accordance with an embodiment of the present invention, the infrared radiation layer may be formed by mixing the first ceramic nanoparticles, the second ceramic nanoparticles, and the third ceramic nanoparticles in a weight fraction of any one of 1:1:1, 1:4:1, and 3:6:7.

For example, the emissivity of the infrared radiation layer may be changed by the weight fraction and thickness (variable) of the materials.

FIGS. 6A and 6B illustrate radiative cooling devices manufactured using ceramic nanoparticle mixtures to which a polymer is added according to embodiments of the present invention.

FIG. 6A compares and illustrates a case in which about 10 wt % of a polymer is added to a mixture formed by mixing ceramic nanoparticles and a case in which no polymer is added.

Referring to a graph 600 of FIG. 6A, the graph 600 illustrates an absorptivity change for each wavelength range. A first absorptivity 601 illustrates the infrared absorptivity of a radiative cooling device formed using a mixture of $SiO_2$, $Al_2O_3$, and $Si_3N_4$ mixed in a weight fraction of 1:1:1, and a second absorptivity 602 illustrates the infrared absorptivity of a radiative cooling device formed by adding about 10 wt % of a polymer to a mixture formed by mixing $SiO_2$, $Al_2O_3$, and $Si_3N_4$ in a weight fraction of 1:1:1.

The numerical data of the graph 600 is summarized in Table 3 below.

TABLE 3

| Material ratio | Average absorptivity (0.3 μm to 2.5 μm) | Average emissivity (8 μm to 13 μm) |
|---|---|---|
| 1:1:1 | 0.049 | 0.81 |
| 1:1:1 + polymer | 0.044 | 0.74 |

Referring to the graph 600 and Table 3, since there is no significant effect on the optical characteristics due to the addition of the polymer, and all samples show a low average absorptivity of 5% or less in the incident sunlight wavelength range, and an average emissivity (absorptivity) in the sky window wavelength range of the atmosphere is 74% or more, the radiative cooling device may be used for radiative cooling during day time and radiative cooling at night.

For example, the polymer may include at least one of polydimethyl siloxane (PDMS), polyurethane acrylate (PUA), polyethylene terephthalate (PET), polyvinyl chloride (PVC), polyvinylidene fluoride (PVDF), and dipentaerythritol hexaacrylate (DPHA).

In accordance with an embodiment of the present invention, the infrared radiation layer of the radiative cooling device may be formed by adding any one polymer of polydimethyl siloxane (PDMS), polyurethane acrylate (PUA), polyethylene terephthalate (PET), polyvinyl chloride (PVC), polyvinylidene fluoride (PVDF), and dipentaerythritol hexaacrylate (DPHA) to the infrared radiation layer formed by coating with the mixed solution.

FIG. 6B illustrates an image of a radiative cooling device manufactured using a mixture prepared by adding the polymer to a mixture of $SiO_2$, $Al_2O_3$, and $Si_3N_4$ mixed in a weight fraction of 1:1:1; and an image of a radiative cooling device manufactured using a mixture of $SiO_2$, $Al_2O_3$, and $Si_3N_4$ mixed in a weight fraction of 1:1:1.

Referring to FIG. 6B, an image 610 illustrates a radiative cooling device manufactured using a mixture prepared by adding the polymer to a mixture of $SiO_2$, $Al_2O_3$, and $Si_3N_4$ mixed in a weight fraction of 1:1:1, and an image 611 illustrates a radiative cooling device formed using a mixture of $SiO_2$, $Al_2O_3$, and $Si_3N_4$ mixed in a weight fraction of 1:1:1.

When a small amount of a polymer such as DPHA is added to a nanoparticle mixture for forming an infrared radiation layer, adhesion between the ceramic nanoparticles and a substrate may be improved.

Here, since the polymer is added in a small amount so as not to affect the absorption in the solar region, the absorption in the solar region is not affected as can be seen from Table 3.

FIGS. 7A and 7B illustrate external temperature measurement data of radiative cooling devices manufactured using ceramic nanoparticle mixtures having different weight fractions according to embodiments of the present invention.

FIG. 7A illustrates external temperature measurement results during day time of a plurality of cooling devices manufactured while adjusting the weight fraction of ceramic nanoparticles, and FIG. 7B illustrates cooling temperature during day time of a plurality of cooling devices manufactured while adjusting the weight fraction of ceramic nanoparticles.

Referring to a graph 700 of FIG. 7A, sunlight 701, a first temperature 702, a second temperature 703, a third temperature 704, a fourth temperature 705, and a fifth temperature 706 are shown.

Here, the first temperature 702 illustrates a case in which a solar reflective layer is only formed on a substrate, the second temperature 703 illustrates a case in which an infrared radiation layer manufactured using a mixture of $SiO_2$, $Al_2O_3$, and $Si_3N_4$ mixed in a ratio of 1:1:1 is formed on a substrate and a solar reflective layer, the third temperature 704 illustrates a case in which an infrared radiation layer manufactured using a mixture of $SiO_2$, $Al_2O_3$, and $Si_3N_4$ mixed in a ratio of 1:4:1 is formed on a substrate and a solar reflective layer, the fourth temperature 705 illustrates a case in which an infrared radiation layer manufactured using a mixture of $SiO_2$, $Al_2O_3$, and $Si_3N_4$ mixed in a ratio of 3:6:7 is formed on a substrate and a solar reflective layer, and the fifth temperature 705 corresponds to the atmospheric layer.

That is, the graph 700 illustrates external temperature measurement data of a radiative cooling device manufactured with only a solar reflective layer without thermal radiation and of a nanoparticle mixture-based radiative cooling device manufactured using a mixture of $SiO_2$, $Al_2O_3$, and $Si_3N_4$ nanoparticles mixed in a weight fraction of 1:1:1, 1:4:1, or 3:6:7.

Comparing the second temperature 703 to the fourth temperature 705 with the fifth temperature 706, the nanoparticle mixture-based radiative cooling devices were cooled by about 8 to 13 degrees for 12 to 16 hours.

In addition, comparing the second temperature 703 to the fourth temperature 705 with the first temperature 702, the second temperature 703 to the fourth temperature 705 were cooled by about 5 to 10 degrees than the first temperature 702 without emissivity.

Referring to a graph 710 of FIG. 7B, a first temperature 711, a second temperature 712, a third temperature 713, and a fourth temperature 714 are shown.

Here, the first temperature 711 illustrates a case in which a solar reflective layer is only formed on a substrate, the second temperature 712 illustrates a case in which an infrared radiation layer manufactured using a mixture of $SiO_2$, $Al_2O_3$, and $Si_3N_4$ mixed in a ratio of 1:1:1 is formed on a substrate and a solar reflective layer, the third temperature 713 illustrates a case in which an infrared radiation layer manufactured using a mixture of $SiO_2$, $Al_2O_3$, and $Si_3N_4$ mixed in a ratio of 1:4:1 is formed on a substrate and a solar reflective layer, and the fourth temperature 714 illustrates a case in which an infrared radiation layer manufactured using a mixture of $SiO_2$, $Al_2O_3$, and $Si_3N_4$ mixed in a ratio of 3:6:7 is formed on a substrate and a solar reflective layer.

Comparing the first temperature 711 with the second temperature 712 to the fourth temperature 714, the second temperature 712 to the fourth temperature 714 corresponding to nanoparticle mixture-based radiative cooling devices were further cooled by about 6 to 10 degrees than the first temperature 711 having no emissivity and only a small absorption of sunlight.

Therefore, the present invention can perform cooling below ambient temperature without consuming energy during day time when sunlight is shining or even during night time when sunlight is not shining, thereby performing a cooling function without energy consumption when applied to the external surface of materials requiring cooling such as buildings and automobiles.

In addition, the present invention can be simultaneously applied to an existing cooling system using energy, thereby improving the energy efficiency of the cooling system.

Further, the present invention can exhibit stable radiative cooling properties even when exposed to an external environment for a long time as nanoparticle materials have excellent chemical stability and mechanical properties (strength and hardness) due to the characteristics of the ceramic materials.

FIG. 8 illustrates the optical characteristics of a radiative cooling device manufactured using a ceramic nanoparticle mixture according to an embodiment of the present invention and a polymer-based radiative cooling device.

Referring to FIG. 8, a graph 800 illustrates the optical characteristics of a radiative cooling device manufactured using a ceramic nanoparticle mixture, and a graph 810 illustrates the optical characteristics of a polymer-based radiative cooling device.

Comparing a change in a first absorptivity 801 of the graph 800 with a change in a second absorptivity 811 of the graph 810, the radiative cooling device manufactured using the ceramic nanoparticle mixture formed of mixed nanoparticles selected from materials having intrinsic emissivity in the sky window of the atmosphere exhibits a selectively high emissivity in a wavelength range of 8 μm to 13 μm corresponding to the sky window of the atmosphere, compared to a polymer-based radiative cooling device.

FIGS. 9A to 9C illustrate the optical characteristics of a radiative cooling device dependent upon the size of particles in a ceramic nanoparticle mixture according to an embodiment of the present invention.

In FIGS. 9A to 9C, a graph 900, a graph 910, and a graph 920 illustrate the absorption and emission characteristics of visible and infrared rays dependent upon the particle size of $SiO_2$ particles included in a ceramic nanoparticle mixture.

Referring to the graph 900 of FIG. 9A, the horizontal variable represents a wavelength, the vertical variable represents an absorptivity, and a first size 901, a second size 902, a third size 903, and a fourth size 904 depend upon the size of $SiO_2$ particles.

Referring to the graph 910 of FIG. 9B, the horizontal variable represents a wavelength, the vertical variable represents an absorptivity, and a first size 911, a second size 912, a third size 913, and a fourth size 914 depend upon the size of $SiO_2$ particles.

Referring to the graph 920 of FIG. 9C, the horizontal variable represents a wavelength, the vertical variable represents an absorptivity, and a first size 921, a second size 922, a third size 923, and a fourth size 924 depend upon the size of $SiO_2$ particles.

In the graphs 900 to 920, the first size may be 50 nm, the second size may be 300 nm, the third size may be 600 nm, and the fourth size may be 2400 nm.

The graphs 900 and 910 represent the same data and exhibit different absorptivity.

That is, since the absorptivity of the graph 900 is 0 to 1.0 and the absorptivity of the graph 910 is 0 to 0.3, the enlarged absorptivity of the graph 900 may correspond to that of the graph 910.

From the graph 910, it can be confirmed that an absorptivity in a wavelength of 400 nm to 700 nm increases as the size of particles increases.

From the graph 920 showing the first size 921 to the fourth size 924 in a wavelength range of 2.5 μm to 15 μm, it can be confirmed that the size of $SiO_2$ particles is 50 nm to 2400 nm in a wavelength range of 8 μm to 10 μm showing a relatively high emissivity.

That is, the particle size of $SiO_2$ nanoparticles among the plural ceramic nanoparticles of the infrared radiation layer may be determined to be 50 nm to 2400 nm such that the absorptivity of infrared rays is increased.

Therefore, the granularity and composition related to the size and thickness of the plural ceramic nanoparticles of the infrared radiation layer may be determined such that the absorptivity of infrared rays is increased in the wavelength range corresponding to the sky window of the atmosphere.

In the above-described specific embodiments, elements included in the invention are expressed singular or plural in accordance with the specific embodiments shown.

It should be understood, however, that the singular or plural representations are to be chosen as appropriate to the situation presented for the purpose of description and that the above-described embodiments are not limited to the singular or plural constituent elements. The constituent elements expressed in plural may be composed of a single number, and constituent elements expressed in singular form may be composed of a plurality of elements.

In addition, the present invention has been described with reference to exemplary embodiments, but it should be understood that various modifications may be made without departing from the scope of the present disclosure.

Therefore, the scope of the present invention should not be limited by the embodiments, but should be determined by the following claims and equivalents to the following claims.

The invention claimed is:

1. A radiative cooling device manufactured using a ceramic nanoparticle mixture, comprising:

a solar reflective layer formed of a metal material to reflect sunlight; and an infrared radiation layer formed by mixing a plurality of ceramic nanoparticles based on any one of a size, thickness, and weight fraction determined in consideration of an absorptivity in a wavelength range corresponding to a sky window of atmosphere and configured to absorb and emit infrared rays in the wavelength range, wherein the infrared radiation layer is formed by mixing at least two ceramic nanoparticle types of first ceramic nanoparticles having a first intrinsic emissivity in a first wavelength range, second ceramic nanoparticles having a second intrinsic emissivity in a second wavelength range, and third ceramic nanoparticles having a third intrinsic emissivity in a third wavelength range.

2. The radiative cooling device according to claim 1, wherein the first wavelength range comprises 8 μm to 10 μm in the wavelength range, the second wavelength range comprises 10 μm to 12.5 μm in the wavelength range, and the third wavelength range comprises 11 μm to 13 μm in the wavelength range.

3. The radiative cooling device according to claim 1, wherein the first ceramic nanoparticles comprise any one ceramic nanoparticle type of $SiO_2$, cBN, and $CaSO_4$ ceramic nanoparticles, the second ceramic nanoparticles comprise $Si_3N_4$ ceramic nanoparticles, and the third ceramic nanoparticles comprise $Al_2O_3$ ceramic nanoparticles.

4. The radiative cooling device according to claim 1, wherein the first intrinsic emissivity comprises an emissivity higher than an emissivity of the second ceramic nanoparticles and third ceramic nanoparticles in the first wavelength range, the second intrinsic emissivity comprises an emissivity higher than an emissivity of the first ceramic nanoparticles and third ceramic nanoparticles in the second wavelength range, and the third intrinsic emissivity comprises an emissivity higher than an emissivity of the first ceramic nanoparticles and second ceramic nanoparticles in the third wavelength range.

5. The radiative cooling device according to claim 1, wherein in the infrared radiation layer, a particle size and composition related to a size and thickness of the plural ceramic nanoparticles are determined such that an absorptivity of the infrared rays is increased in the wavelength range.

6. The radiative cooling device according to claim 1, wherein the plural ceramic nanoparticles comprise at least two ceramic nanoparticle types of $SiO_2$, $Al_2O_3$, $Si_3N_4$, CBN, $CaSO_4$, $TiO_2$, ALON, $BaTiO_3$, BeO, $Cu_2O$, $MgAl_2O_4$, $SrTiO_3$, $Y_2O_3$, $Bi_{12}SiO_{20}$, $CaCO_3$, $LiTaO_3$, $KNbO_3$, $NaNo_3$, $ZrSiO_4$, and $CaMg(Co_3)_2$.

7. The radiative cooling device according to claim 1, wherein in the infrared radiation layer, each of the plural ceramic nanoparticles is comprised in any one structure of a single particle structure and a multiple core shell structure.

8. The radiative cooling device according to claim 1, wherein the infrared radiation layer is formed by single coating a mixed solution, in which the plural ceramic nanoparticles are mixed, on the solar reflective layer by any one method of spin coating, drop coating, bar coating, spray coating, doctor blading, and blade coating.

9. The radiative cooling device according to claim 8, wherein any one polymer of polydimethyl siloxane (PDMS), polyurethane acrylate (PUA), polyethylene terephthalate (PET), polyvinyl chloride (PVC), polyvinylidene fluoride (PVDF), and dipentaerythritol hexaacrylate (DPHA) is added to the infrared radiation layer formed by coating with the mixed solution.

10. The radiative cooling device according to claim 1, wherein the infrared radiation layer is formed by mixing the first ceramic nanoparticles, the second ceramic nanoparticles, and the third ceramic nanoparticles in any one weight fraction of 1:1:1, 1:4:1, and 3:6:7.

11. The radiative cooling device according to claim 1, wherein the solar reflective layer is formed of at least one metal material selected from silver (Ag), aluminum (Al), gold (Au), copper (Cu), titanium (Ti), chromium (Cr), manganese (Mn), iron (Fe), and platinum (Pt) or any one material of alloy materials in which at least two of the metal materials are combined.

* * * * *